United States Patent [19]

Egelstam

[11] Patent Number: 4,881,007

[45] Date of Patent: Nov. 14, 1989

[54] COMPACT GAS DISCHARGE TUBE AND A METHOD FOR ITS MANUFACTURE

[75] Inventor: Hans Egelstam, Karlskrona, Sweden

[73] Assignee: Lumalampan Aktiebolag, Sweden

[21] Appl. No.: 165,503

[22] Filed: Mar. 8, 1988

[30] Foreign Application Priority Data

Mar. 23, 1987 [SE] Sweden ..... 8701184

[51] Int. Cl.[4] ..... H01J 9/24; H01J 61/32

[52] U.S. Cl. ..... 313/493; 313/634; 445/22; 445/26

[58] Field of Search ..... 313/493, 634; 445/17, 445/22, 26, 33, 29

[56] References Cited

U.S. PATENT DOCUMENTS 4,645,972 2/1987 Takao et al. ..... 313/493 X
4,745,323 5/1988 Northrop et al. ..... 313/493 X

FOREIGN PATENT DOCUMENTS 3437212 4/1986 Fed. Rep. of Germany .
60-93753 5/1985 Japan .

*Primary Examiner*—Kenneth Wieder

*Attorney, Agent, or Firm*—Roylance, Abrams, Berdo & Goodman

[57] ABSTRACT

A method for producing a compact gas-discharge tube, or lamp, and the tube or lamp so produced, comprising making at least two U-shaped main tube components of glass tube. The tube components are joined together at one limb to form a closed, continuous discharge chamber provided with electrodes at each outer end thereof and a layer of fluorescent substance on the inner glass surface thereof. The main tube components are joined together by heating an obliquely cut, free limb and of one main tube component and joining this heated end to a corresponding, heated end of a second main tube component. The resultant connection is formed while applying heat and is bent in a manner such as to have a U-shaped configuration, substantially devoid of discontinuities. The invention also relates to a compact gas-discharge tube of this kind in which the free, internal cross-section area of the connection is at least 50% of the corresponding area of the limbs, and in which the glass thickness of the connection is equal to at least 50% of the glass thickness of the limbs.

22 Claims, 3 Drawing Sheets

COMPACT GAS DISCHARGE TUBE AND A METHOD FOR ITS MANUFACTURE

FIELD OF THE INVENTION

The present invention relates to a method for producing a compact gas discharge tube and the tube so produced of the kind which comprises at least two U-shaped main tube components which are made of glass and which are mutually joined together at one limb thereof, to form a closed, continuous gas discharge chamber which is provided with electrodes at each outer end thereof and which has a layer of fluorescent or luminescent material provided on its inner glass surfaces.

BACKGROUND AND PRIOR ART

A method and a compact gas discharge tube of this kind are known from e.g., European Patent Application No. 84113977.7. In the case of this known discharge tube, or envelope, the ends of those limbs in which no electrode is fitted are sealed off prior to effecting the connection or juncture between the two U-shaped main components. This connection is effected in a manner similar to that described in British Patent Application No. 2 048 562 A, i.e. the tube wall is heated in the proximity of the end of the limb of one main component, so as to soften the glass, after which a tubular collar is blown out from the glass wall, perpendicularly thereto. A corresponding collar is then produced on the other main component of the discharge chamber in a similar manner, and the two collars are joined together by applying heat thereto, so as to form a short, narrow connecting tube. Although this known method may appear attractive from the aspect of manufacture, it has been found to have several drawbacks. For instance, the glass is not uniformly distributed during the glass softening stage of the process, thereby giving rise to stress concentrations and to the risk of fracture. Furthermore, the narrow connecting tube is liable to crack, both during manufacture and during use. A substantial risk of such a failure occurs when fitting the discharge tube, or envelope, onto its lamp fittings. The quality of the discharge tube is also impaired by the fact that the cross-sectional area of the connecting tube is much smaller than the cross-sectional area of the remainder of the discharge tube, which has a negative effect on the light emittin g properties of the discharge tube. This is due to the fact that every constriction in the path of the gas discharge results in an increase in the total operating voltage and therewith in greater losses in the discharge path. Since this increase in losses does not result in a corresponding increase in light flux, it will only impair the efficiency of the discharge tube. Moreover, the presence of constrictions in the discharge path results in a higher striking voltage, or starting voltage, which negatively effects the willingness of the discharge tube to ignite at low temperatures. In addition, the necessary cold zones are only produced at the outer end of the lamp incorporating such a discharge tube, which represents a disadvantage, since the gas discharge lamps must be capable of functioning irrespective of their orientation. For example, the temperature at which the optimal mercury vapour pressure is engendered may prevail at the location where the discharge tube is connected to the lamp base.

ADVANTAGES OF THE INVENTION

One object of the present invention is therefore to overcome the aforesaid drawbacks inherent with known methods for producing compact gas discharge tubes and with discharging tubes produced in accordance therewith. Another object is to provide a method of tube manufacture which is simpler and thus more economical than known methods. A further object of the invention is to enable the wall thickness of the glass tubes from which the compact discharge tubes, or lamps, are made to be reduced without affecting the strength of the discharge tubes. These and other objects of the invention together with advantages afforded thereby are achieved with the method and the compact gas-discharge tube according to the invention as will be evident to those skilled in these arts from this specification.

SUMMARY OF THE INVENTION

The invention is based on the realization that the connection between U-shaped single tubes in a so-called multi-finger tube should also be given an essentially U-shape configuration and be connected directly to the straight limbs of the single tubes. A connection of this kind would overcome the aforementioned problems concerning illumination technique and mechnical strength. However, present day glass-blowing and glass-shaping techniques used for shaping the U-shaped bend in a single tube can not be used with multi-finger tubes, since in this case the space is restricted by the limb incorporating the cathode. Furthermore, it is, of course, always more difficult to orient and fix the tubes in two planes than in a single plane. This problem is solved in accordance with the invention by using as starting material single tubes which have been suitably bevelled, instead of starting manufacture from standard straight tubes in accordance with conventional techniques. This enables the glass tubes to be joined end to end while heating the glass and bending the tubes to an appropriate U-shape, without unnecessarily concentrating glass in certain parts of the bend or tube areas adjacent thereto.

BRIEF DESCRIPTION OF THE DRAWING

The invention will now be described in more detail with reference to the accompanying drawings, in which.

DETAILED DESCRIPTION

Figure 1:
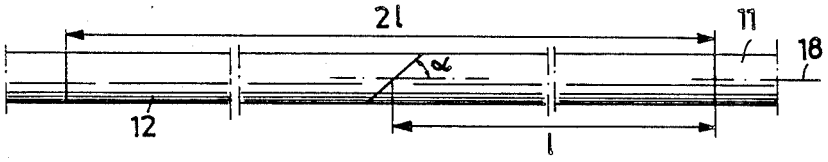
FIG. 1 illustrates a glass tube blank from which a straight glass tube is formed for the production of a compact gas-discharge tube, or lamp, according to the invention.

Similarly to known methods for producing compact gas-discharge tubes, the inventive compact tubes are produced from starting tubes in the form of long straight tubes 11 which have an outer diameter of 10–15 mm and a wall thickness of 0.9–1.4 mm. In accordance with the invention, it is preferred to use starting tubes which have an outer diameter of 12.0–12.5 mm and a wall thickness of 1.05–1.15 mm. The original starting tubes have a length of from 1 to 2 meters and are cut into shorter tube blanks 12, which are intended to form U-shaped main components 13, 13' in the final gas-discharge tube. The length of each tube blank 12 is determined by the desired size of the gas-discharge tube under production, and may vary widely, e.g. from 200 to 800 mm. As illustrated in FIG. 1, the starting tubes 11 are cut alternately along lines which extend at right angles to the longitudinal axis 18 of respective tubes and obliquely to said axis. The tubes are preferably separated with the aid of thin cutting discs, so as to avoid unnecessary waste and to produce edges which are as smooth as possible.

Figure 2:
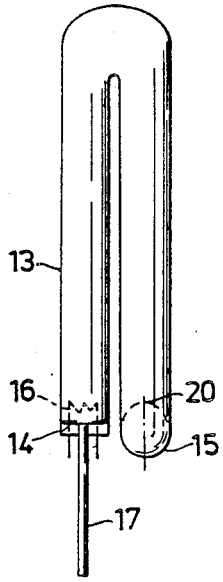
FIG. 2 is a side view of a U-shaped main tube component.
Figure 3:
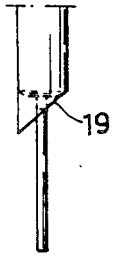
FIG. 3 is a side view of the lower part of the same main tube component, but turned through 90°.
Figure 4:
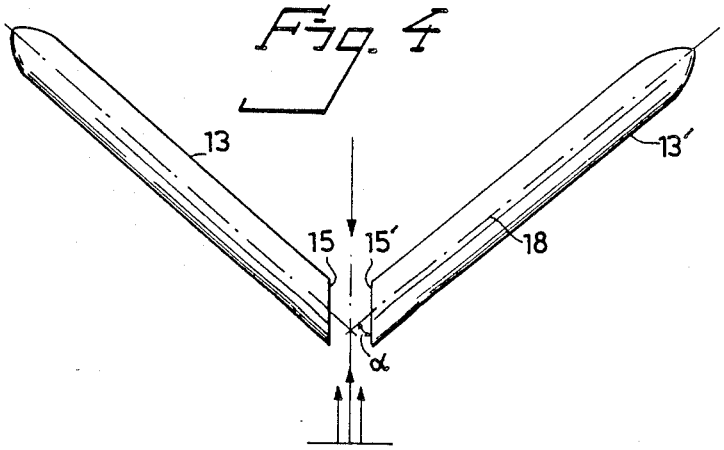
FIGS. 4–7 are side views which illustrate the various stages of joining two U-shaped main tube components together.

The tube blanks 12 are then formed into the U-shaped main components 13, 13' in a known manner and coated internally with a luminescent, fluorescent, substance. The tube areas at the free ends 14, 15 of the tubes are then brushed clean of fluorescent substance, so that said substance will not disturb subsequent treatment. The straight cut tube ends 14 are then fitted with an electrode 16 and an exhaust tube 17. Only one of the main tube components 13, 13' need be provided with an exhaust tube 17, which is used for evacuating the combined tube components 13, 13', and then for flushing the components with an inert gas and for filling the same with rare or noble gas. Subsequent to squeezing together the straight-cut tube end 14, the obliquely-cut tube end 15 will depend slightly below the tube end 14, as illustrated in FIGS. 2 and 3, thereby enabling the bevelled or obliquely-cut tube ends 15, 15' to be moved towards one another without being obstructed by the straight tube-ends 14, 14'. The alternate oblique cuts, or saw cuts, are made along a line which is inclined at an angle of from 20° to 50° to the longitudinal axis 18 of the respective starting tubes 11. Prior to shaping the tube blanks 12 into the main tube components 13, the tube blanks are positioned so that the longitudinal normal plane 20 of the end surface 19 extends essentially at right angles to the main plane of the main tube component 13, as in the drawing plane of FIG. 2. As is clear from the simple geometry shown in FIGS. 1 and 4, the angle between the two components 13,13' at their axes 18 will be 2.

Figure 5:
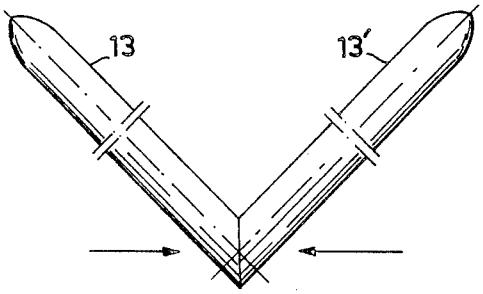
Figure 6:
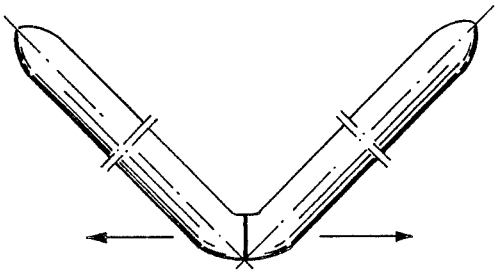
Figure 7:
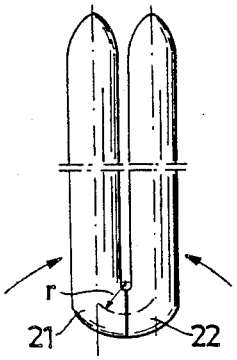
Figure 8:
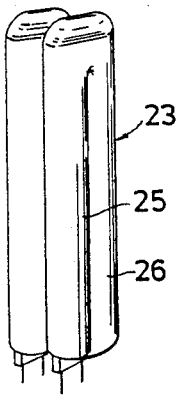
FIG. 8 is a perspective view of a completed four finger tube.
Figure 9:
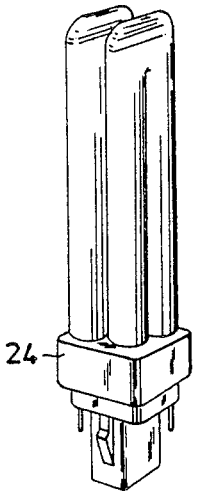
FIG. 9 illustrates the tube of FIG. 8 fitted with a lamp base.

When joining the main tube components 13, 13' together, the ends 15, 15' of respective components are first heated until the glass reaches its "liquid limit". The term "liquid limit", as is known in the art, refers to a temperature just below the melting point of the glass and a condition of the glass such that the tube ends will fuse together without forming any discontinuities. The end surfaces 19, 19' are then pressed together, as shown by the arrows in FIG. 5, therewith forming a collar of liquid glass around the joint, this collar being equalized by drawing the main tube components slightly away from one another in the manner illustrated in FIG. 6. That is, after this equalization by drawing the glass, the glass in the curved portion is both uniform through the curve and is of a thickness approximately equal to the thickness of the glass in the straight portions. This also creates a suitable radius of curvature r for the connection 21. This formation of the juncture between the tube components is facilitated when heat is applied during the whole duration of the process. The main tube components are then bent up towards each other, so that the connection or juncture 21 obtains a U-shaped configuration. During this final phase, a suitable gas is pumped in through the exhaust tube 17, so as to generate an over-pressure in the sealed glass tube, or envelope. In this way there is produced a pressure outwards in the actual bend 22, which sustains the circular cross-sectional shape of the bend, despite the known tendency of this cross-sectional area to diminsh during a bending operation. Subsequent to evacuating the composite gas-discharge tube and filling the same with rare gas, in a conventional manner, the glass gas-discharge tube 23 can be fitted with a lamp base and therewith form a complete compact gas-discharge tube, or lamp.

As mentioned above, a compact gas-discharge tube produced in accordance with the invention method will possess a number of advantageous properties, which are contingent on the fact that the connection 21 has a sufficiently large cross-sectional area and is not encumbered with pronounced irregularities or discontinuities. A suitable balance between the requirements of lamp function and the practicalities of producing the lamp, or tube, in a reasonable manner reveals that the inner cross-sectional area of the connection, or juncture, should in the range of 50% to 100% and preferably in the range of 50% to 75 of the free, internal cross-sectional area of the straight tube limbs 25, 26, and that the overall glass thickness in said connection should in the range of 50% to 100% and preferably in the range of 50% to 75 of the glass thickness of said limbs. Thus, the connection should exhibit a continuous U-shape substantially free from variations in glass thickness or cross-sectional area.

Figure 12:
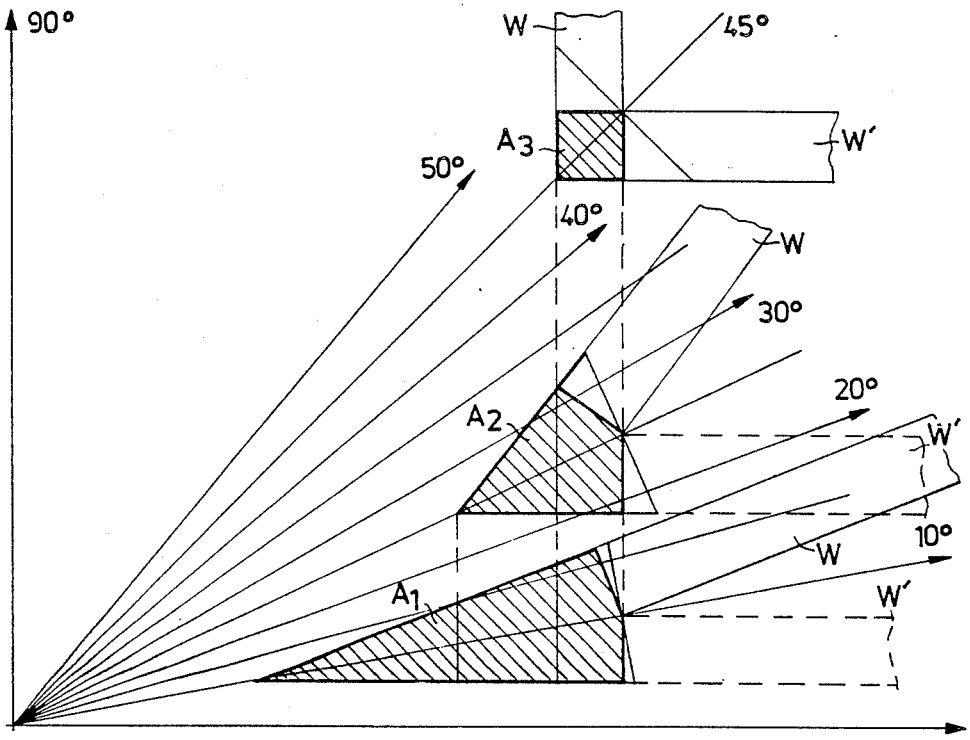
FIG. 12 is a diagram which illustrates schematically the amount of glass present in the juncture between respective tubes, at different angles in the bevelled regions thereof.

The quantity of glass present in the connection 21, and therewith the wall thickness of the connection, can be varied by appropriate selection of the angle of the oblique cut to the longitudinal axis 18 of the starting tubes 11. It will be seen from FIG. 12 that the quantity of glass present in said connection becomes greater when the angle of bevel is decreased. In the FIG. 12 illustration, W and W' identify the glass wall of the tube components 13, 13', and the hatched areas A indicate the amount of glass available for producing the actual bend 22. The most suitable bevel angle has been found to lie between 35°–40°, which provides a compact gas-discharge tube having very good illuminating properties, from a technical aspect, and capable of being manufactured from thinner glass tube than those hitherto used in compact gas-discharge tubes of this kind, without impairing the mechanical strength of the tube.

Figure 10:
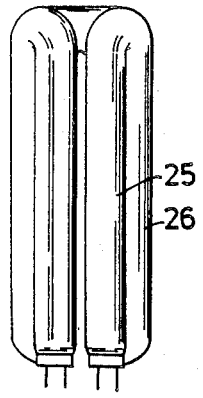
FIG. 10 is a side view of a six finger gas discharge tube that has been produced in accordance with the invention.
Figure 11:
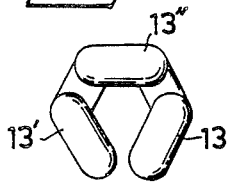
FIG. 11 shows the tube of FIG. 10 in plan view.

It will be understood that the invention can be modified in many ways within the spirit of the invention and the scope of the following claims. For example, any selected number of U-shaped main tube components can be joined together in the aforedescribed manner. A six-finger tube, or envelope, comprising three main tube components 13, 13', 13'' is illustrated in FIGS. 10 and 11. In this case, the longitudinally extending normal planes 20 of the end surfaces 19 shall be oriented so as to extend outwardly from the major planes of the three main components 13, 13' and 13'' are positioned at an angle of substantially 120°. This will cause each of the three main components to be orientation at the same angle of about 120° with respect to its adjacent two components, as shown in FIG. 11.

I claim:

1. A method of producing a compact gas-discharge lamp tube which is made up of at least two U-shaped main tube components, said tube components being made of glass and being coated with a fluorescent layer on their inner surfaces and each having at least two limbs, comprising the steps of shaping at least one free limb end of each of said tube components to form end surfaces thereon positioned obliquely to the longitudinal axis of each respective limb, heating said ends with said obliquely positioned end surfaces, joining said components together by joining said heated end surfaces together, bending the thus formed joined together regions between said components to form a U-shaped connection between said components at said region, the joined together at least two tube components thus forming one continuous discharge chamber having two free ends, providing electrode means at each of said free ends of said one continuous chamber, and sealing said continuous chamber around said electrode means at both of said free ends.

2. The method of claim 1, and the step of forming said U-shaped tube components from straight glass tubes, performing said step of shaping said at least one free end by cutting said straight glass tubes to form said obliquely positioned end surfaces, and then forming the cut sections of said straight tube into said U-shaped tube components.

3. The method of claim 1, positioning said end surfaces at an angle to said limb axis between about 20° to about 50°.

4. The method of claim 3, positioning said end surfaces at an angle to said limb axis between about 35° to about 40°.

5. The method of claim 1, performing said step of joining by bringing said heated end surfaces into planar contact with each other so as to fuse them together, performing said step of bending and forming by drawing the fused together tube components apart in such a manner as to equalize the thickness of the glass and to produce a predetermined radius of curvature in said region, and further heating said region while performing the bending of said limbs towards each other, whereby the glass material is further equalized and said curved region is formed substantially free of any discontinuity.

6. The method of claim 5, wherein said drawing step is performed in such a manner that the thickness of the glass in said curved region and the internal cross-sectional area through said curved region are both in the range of about 50% to about 100% of the glass thickness and the cross-sectional area, respectively, of the limb portions of said main tube components.

7. The method of claim 6, wherein said range is about 50% to about 75%.

8. The method of claim 2, and prior to performing said forming step, performing the step of orienting said end surfaces so that a longitudinally extending plane normal to said end surfaces will be located at about a right angle to the main plane of said tube component.

9. The method of claim 2, and prior to performing said forming step, performing the step of orienting said end surfaces so that a longitudinally extending plane normal to said end surfaces will be located at an angle of about 120° to the main plane of said tube component.

10. A compact gas-discharge lamp tube defining a closed discharge chamber comprising at least two U-shaped main tube components, each of said main tube components being made of glass and each having at least two limbs, a fluorescent layer coated on the inside surface of said lamp tube, a U-shaped connection portion joining said at least two main tube components together at two free limb ends thereof, electrode means provided one at each of the two outer free ends and said lamp tube closed discharge chamber, and the glass thickness of the internal cross-sectional area in said U-shaped connection portion being in the range of about 50% to about 100% of the glass thickness and the cross-sectional area, respectively, of the limbs of said main tube components.

11. The compact gas-discharge lamp tube of claim 10, wherein said range is about 50% to about 75%.

12. The compact gas-discharge lamp tube of claim 10, wherein the thickness o the glass in said U-shaped connection portion is substantially uniform throughout said U-shaped connection portion and is substantially free of any discontinuities.

13. The compact gas-discharge lamp tube of claim 10, wherein said lamp tube comprises two of said main tube components, and the main planes of said two main tube components are positioned substantially parallel to each other.

14. The compact gas-discharge lamp tube of claim 10, wherein said lamp tube comprises three of said main tube components, and the main planes of said three main tube components are positioned with each such main plane at an angle of substantially 120° to each of the two adjoining main planes.

15. A compact gas-discharge lamp tube defining a discharge chamber comprising at least two U-shaped main tube components, each of said main tube components being made of glass and each having at least two limbs; said lamp tube being the product of a process comprising the steps of forming said components from straight glass tubes, forming oblique end surfaces on said limbs of said components, and heating, joining and bending said limbs at said oblique end surfaces to form a U-shaped connection portion joining said at least two main tube components together at two free limb ends thereof; and said lamp tube defining one continuous discharge chamber having two free open ends only.

16. The lamp tube of claim 15, a fluorescent layer coated on the inside surface of said lamp tube, electrode means provided one at each of the two outer free ends of said lamp tube discharge chamber, and the glass thickness and the internal cross-sectional area in said U-shaped connection portion being in the range of about 50% to about 100% of the glass thickness and the cross-sectional area, respectively, of the limbs of said main tube components.

17. The lamp tube of claim 16, wherein said range is about 50% to about 75%.

18. The lamp tube of claim 16, wherein the thickness of the glass in said U-shaped connection portion is substantially uniform throughout said U-shaped connection portion and is substantially free of any discontinuities.

19. The lamp tube of claim 15, wherein said lamp tube comprises two of said main tube components, and the main planes of said two main tube components are positioned substantially parallel to each other.

20. The lamp tube of claim 15, wherein said lamp tube comprises three of said main tube components, and the main planes of said three main tube components are positioned with each such main plane at an angle of substantially 120° to each of the two adjoining main planes.

21. The lamp tube of claim 15, wherein said oblique end surfaces are at an angle to the limb axis in the range of about 20° to about 50°.

22. The lamp tube of claim 21, wherein said range is about 35° to about 40°.

* * * * *